US008424337B2

(12) United States Patent
Scarcella et al.

(10) Patent No.: US 8,424,337 B2
(45) Date of Patent: Apr. 23, 2013

(54) REFRIGERANT VAPOR COMPRESSION SYSTEM WITH LUBRICANT COOLER

(75) Inventors: Jason Scarcella, Cicero, NY (US); Kursten Lamendola, Chittenango, NY (US)

(73) Assignee: Carrier Corporation, Farmington, CT (US)

( * ) Notice: Subject to any disclaimer, the term of this patent is extended or adjusted under 35 U.S.C. 154(b) by 393 days.

(21) Appl. No.: 12/745,772

(22) PCT Filed: Jan. 17, 2008

(86) PCT No.: PCT/US2008/051342

§ 371 (c)(1), (2), (4) Date: Jun. 2, 2010

(87) PCT Pub. No.: WO2009/091403

PCT Pub. Date: Jul. 23, 2009

(65) Prior Publication Data

US 2010/0251756 A1 Oct. 7, 2010

(51) Int. Cl.
*F25B 43/02* (2006.01)

(52) U.S. Cl.
USPC ..... 62/470

(58) Field of Classification Search ..... 62/468, 62/470, 471, 498, 513
See application file for complete search history.

(56) References Cited

U.S. PATENT DOCUMENTS

| | | | | |
|---|---|---|---|---|
| 2,963,886 | A | 12/1960 | Palmatier | |
| 3,759,348 | A * | 9/1973 | Kasahara | 184/6.23 |
| 4,406,589 | A * | 9/1983 | Tsuchida et al. | 417/295 |
| 4,516,916 | A * | 5/1985 | English et al. | 417/368 |
| 4,949,546 | A * | 8/1990 | Klusmier et al. | 62/6 |
| 5,033,944 | A * | 7/1991 | Lassota | 418/1 |
| 5,222,874 | A * | 6/1993 | Unnewehr et al. | 417/372 |
| 5,245,833 | A * | 9/1993 | Mei et al. | 62/113 |
| 5,570,583 | A * | 11/1996 | Boehde et al. | 62/84 |
| 5,624,236 | A * | 4/1997 | Kubo et al. | 417/12 |
| 5,899,091 | A * | 5/1999 | Fraser et al. | 62/473 |
| 6,058,727 | A | 5/2000 | Fraser, Jr. et al. | |
| 6,170,286 | B1 * | 1/2001 | Keuper | 62/471 |
| 6,182,467 | B1 | 2/2001 | Zhong et al. | |
| 6,233,967 | B1 * | 5/2001 | Seewald et al. | 62/470 |
| 6,457,325 | B1 * | 10/2002 | Vetter | 62/473 |
| 6,481,243 | B1 * | 11/2002 | Fang et al. | 62/513 |
| 6,579,335 | B2 * | 6/2003 | Ollinger | 55/459.1 |
| 7,032,410 | B2 * | 4/2006 | Barratt et al. | 62/473 |
| 2004/0112679 | A1 * | 6/2004 | Centers | 184/7.4 |
| 2007/0214827 | A1 * | 9/2007 | Venkatasubramaniam | 62/468 |

FOREIGN PATENT DOCUMENTS

| | | |
|---|---|---|
| JP | 1314873 | 12/1989 |
| WO | 2006095572 | 9/2006 |

OTHER PUBLICATIONS

ISA/US International Search Report and Written Opinion dated Jul. 8, 2008 (7 pgs).
International Preliminary Report on Patentability issued Jul. 20, 2010 (5 pgs.).

* cited by examiner

*Primary Examiner* — Mohammad Ali
(74) *Attorney, Agent, or Firm* — Cantor Colburn LLP

(57) ABSTRACT

A refrigerant vapor compression system is provided that includes a refrigerant circuit and a lubricant cooler circuit. The lubricant cooler circuit is operatively associated with the compression device for cooling a lubricant associated with the compression device and includes a heat exchanger coil disposed downstream of the refrigerant heat absorption heat exchanger with respect to the flow of heating medium. The lubricant cooler heat exchanger defines a flow path for passing the lubricant in heat exchange relationship with the cooled heating medium leaving the refrigerant heat absorption heat exchanger.

6 Claims, 2 Drawing Sheets

REFRIGERANT VAPOR COMPRESSION SYSTEM WITH LUBRICANT COOLER

FIELD OF THE INVENTION

This invention relates generally to refrigerant vapor compression systems and, more particularly, to controlling the temperature of the lubricant used to lubricate the compression mechanism of the compression device of a refrigerant vapor compression system.

BACKGROUND OF THE INVENTION

Refrigerant vapor compression systems are well known in the art and commonly used for conditioning air to be supplied to a climate controlled comfort zone within a residence, office building, hospital, school, restaurant or other facility. Refrigerant vapor compression systems are also commonly used in transport refrigeration systems for refrigerating air supplied to a temperature controlled cargo space of a truck, trailer, container or the like for transporting perishable items. Conventional refrigerant vapor compression systems include four basic components: a compressor, a refrigerant heat rejection heat exchanger, an expansion device and a refrigerant heat absorption heat exchanger that functions as a refrigerant evaporator. Depending upon whether the refrigerant vapor compression system is operating in a subcritical cycle or a transcritical cycle, the refrigerant heat rejection heat exchanger functions, respectively, as a refrigerant condenser or a refrigerant gas cooler. These basic refrigerant system components are interconnected by refrigerant lines in a closed refrigerant circuit, arranged in accord with known refrigerant vapor compression cycles, and operated in the subcritical pressure range for the particular refrigerant in use.

The compressor functions to compress low pressure, low temperature refrigerant vapor to a high pressure and high temperature refrigerant vapor. Whether the compressor is a reciprocating compressor, a scroll compressor, a rotary compressor or screw compressor, it includes a compression mechanism driven by a motor and having rotating or orbiting elements that interact to compress the refrigerant vapor passing through the compressor. It is common practice to include a lubricant in the compressor to reduce wear of the compression mechanism and its parts, as well as to seal gaps between the interacting elements to reduce refrigerant vapor leakage during the compression process. As the lubricant becomes heated due to exposure to the high temperatures generated in the compression process, its viscosity is reduced which impairs its friction reducing ability and its sealing effectiveness. Therefore, it is customary to provide for cooling of the lubricant.

For example, U.S. Pat. No. 5,899,091 discloses a refrigeration system wherein compressor lubricating oil is cooled by passing the lubricating oil in heat exchange relationship with the post-expansion economizer refrigerant flow. U.S. Pat. No. 6,058,727 discloses a refrigeration system wherein the compressor lubricating oil is passed through a heat exchange coil disposed in heat exchange relationship with refrigerant vapor leaving the evaporator to cool the lubricating oil.

SUMMARY OF THE INVENTION

In an aspect of the invention, a refrigerant vapor compression system is provided that includes a refrigerant circuit and a lubricant cooler circuit.

The refrigerant circuit includes a refrigerant compression device, a refrigerant heat rejection heat exchanger for passing refrigerant received from said compression device at a high pressure in heat exchange relationship with a cooling medium, and a refrigerant heat absorption heat exchanger for passing refrigerant at a low pressure refrigerant in heat exchange relationship with a heating medium disposed in refrigerant flow communication in a refrigeration cycle, and a lubricant cooler circuit. The lubricant cooler circuit is operatively associated with the compression device for cooling a lubricant associated with the compression device and includes a heat exchanger coil disposed downstream of the refrigerant heat absorption heat exchanger with respect to the flow of heating medium. The lubricant cooler heat exchanger defines a flow path for passing the lubricant in heat exchange relationship with the cooled heat medium leaving the refrigerant heat absorption heat exchanger. The lubricant cooler heat exchanger coil may further include an inlet leg for passing lubricant to be cooled to the lubricant flow path through the lubricant cooler heat exchanger coil and an outlet leg for passing lubricant having been cooled from the lubricant flow path through the lubricant cooler heat exchanger coil.

In an embodiment of the refrigerant vapor compression system, the compression device comprises a hermetic compressor having a casing housing a compression mechanism, an oil-cooled motor driving the compression mechanism, and an oil sump for collecting oil for cooling the motor. In this embodiment, the inlet leg of the lubricant cooler heat exchanger coil is in flow communication with the oil sump for receiving oil to be cooled and the outlet leg of the lubricant cooler heat exchanger coil is in flow communication with the oil sump for returning oil having been cooled to the oil sump.

In an embodiment of the refrigerant vapor compression system, the compression device comprises a hermetic compressor having a casing housing a compression mechanism and a motor driving the compression mechanism, and the lubricant cooler circuit further includes an oil separator. The oil separator is disposed in the primary refrigerant circuit upstream with respect to refrigerant flow of the hermetic compressor and downstream with respect to refrigerant flow of the refrigerant heat rejection heat exchanger. In this embodiment, the inlet leg of the lubricant cooler heat exchanger coil is in flow communication with the oil separator for receiving oil to be cooled and the outlet leg of the lubricant cooler heat exchanger coil is in flow communication with the hermetic compressor for returning oil having been cooled to said hermetic compressor.

In an embodiment, the refrigerant heat absorption heat exchanger is a refrigerant evaporator heat exchanger and the heating medium is air from a climate controlled environment, such as a perishable cargo storage zone of a refrigerated transport container.

BRIEF DESCRIPTION OF THE DRAWINGS

For a further understanding of the invention, reference will be made to the following detailed description of the invention which is to be read in connection with the accompanying drawing, where.

DETAILED DESCRIPTION OF THE INVENTION

Figure 1:
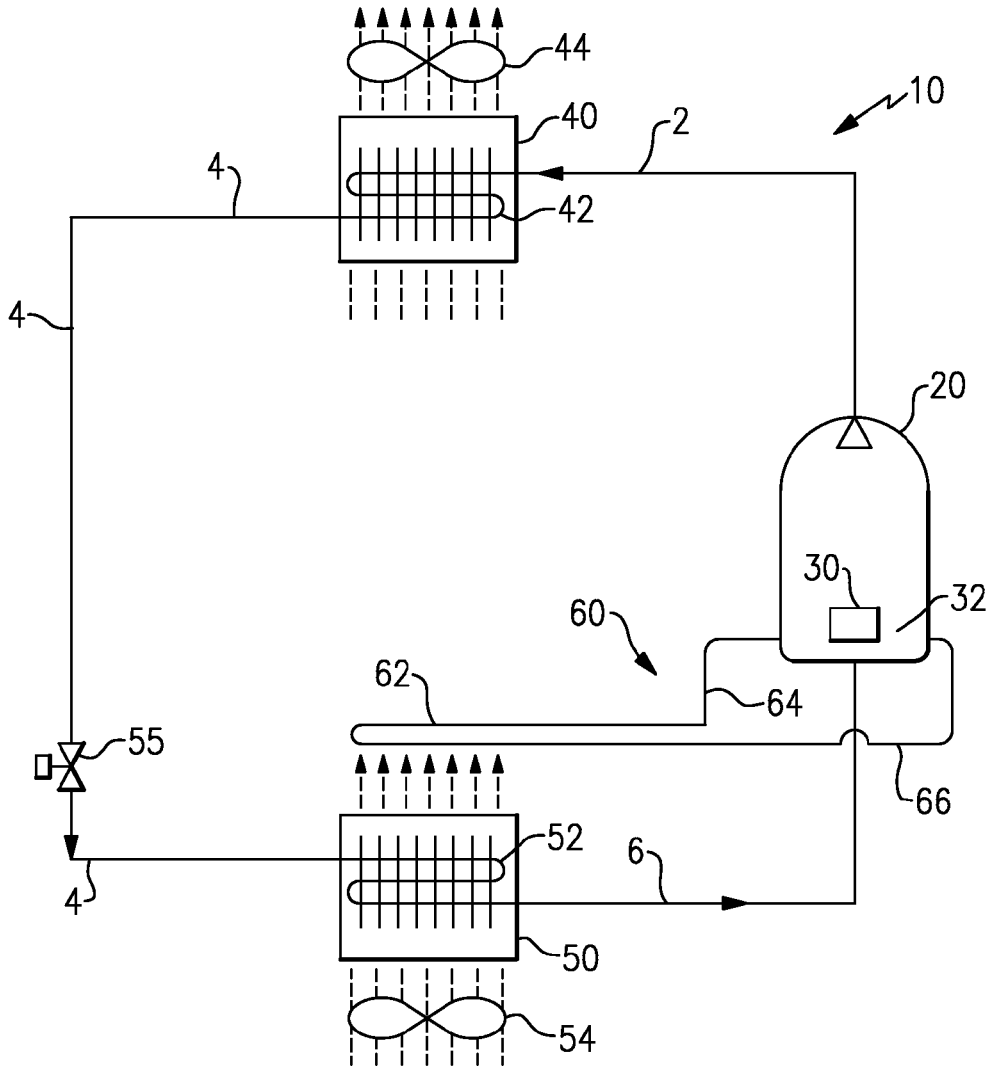
FIG. 1 is a schematic diagram illustrating an exemplary embodiment of a refrigerant vapor compression system in accord with the invention including a compressor driven by an oil-cooled motor.

Referring now to FIG. 1, the refrigerant vapor compression system 10 includes a compression device 20 driven by a motor 30 operatively associated therewith, a refrigerant heat rejecting heat exchanger 40, an evaporator expansion device 55, and a refrigerant heat absorbing heat exchanger 50, also referred to herein as an evaporator, connected in a closed loop refrigerant circuit in series refrigerant flow arrangement by various refrigerant lines 2, 4 and 6. The evaporator expansion device 55 is disposed in refrigerant line 4 downstream with respect to refrigerant flow of the refrigerant heat rejection heat exchanger 40 and upstream with respect to refrigerant flow of the evaporator 50.

If the refrigerant vapor compression system 10 is operating in a subcritical cycle, the refrigerant heat rejecting heat exchanger 40 is designed to operate as a refrigerant condensing heat exchanger through which hot, high pressure refrigerant vapor discharged from the compression device 20 passes in heat exchange relationship with a cooling medium to condense the refrigerant passing therethrough from a refrigerant vapor to refrigerant liquid. If the refrigerant vapor compression system 10 is operating in a transcritical cycle, the refrigerant heat rejecting heat exchanger 40 is designed to operate as a refrigerant desuperheating heat exchanger through which hot, high pressure refrigerant vapor discharged from the compression device 20 passes in heat exchange relationship with a cooling medium to cool to a lower temperature, but not condense, the refrigerant vapor passing therethrough. The refrigerant condensing heat exchanger 40, may comprise a finned tube heat exchanger 42, such as for example, a fin and round tube heat exchange coil or a fin and flat mini-channel tube heat exchanger. In transport refrigeration system applications, as in air conditioning and in commercial refrigeration applications, the typical cooling medium is ambient air passed through the condenser 40 by means of fan(s) 44 operatively associated with the condenser 40 in heat exchange relationship with the refrigerant flowing through the heat exchanger 42.

The evaporator 50 constitutes a refrigerant evaporating heat exchanger, such as a conventional finned tube heat exchanger 52, such as for example a fin and round tube heat exchange coil or a fin and mini-channel flat tube heat exchanger, through which expanded refrigerant having traversed the expansion device 55 passes in heat exchange relationship with a heating fluid, whereby the refrigerant is vaporized and typically superheated. The expansion device 55, which also meters refrigerant flow to the evaporator 50, may be an expansion valve, such as an electronic expansion valve or a thermostatic expansion valve, or a fixed orifice metering device, such a capillary tube. The heating fluid passed in heat exchange relationship with the refrigerant in the evaporator 50 may be air passed through the evaporator 50 by means of fan(s) 54 operatively associated with the evaporator 50, to be cooled and commonly also dehumidified, and thence supplied to a climate controlled environment such as a perishable cargo, such as for example refrigerated or frozen food items, storage zone associated with a transport refrigeration system, or a display case or cold room associated with a commercial refrigeration system, or an air conditioned space.

The compression device 20 functions to compress and circulate refrigerant through the refrigerant circuit as will be discussed in further detail hereinafter. The compression device 20 may be a single-stage compression device, such as for example, but not limited to, a scroll compressor, a reciprocating compressor or rotary compressor, or a multi-stage compression device having at least a first low pressure compression stage and a second high pressure compression stage, such as for example, but not limited to, a scroll compressor, a reciprocating compressor or a screw compressor. In the embodiment depicted in FIG. 1, the compression device 20 of the refrigerant vapor compression system 10 comprises a hermetic or semi-hermetic compressor driven by an oil-cooled motor. In the embodiment depicted in FIG. 2, the compression device 20 of the refrigerant vapor compression system 10 comprises a hermetic or semi-hermetic compressor driven by a refrigerant-vapor cooled motor.

In a hermetic or a semi-hermetic compressor, the compressor drive motor 30 operatively associated with the compression mechanism of the compressor is disposed within the housing of the compressor 20, generally at an end of the drive shaft opposite the compression mechanism. The compressor drive motor 30 may be oil-cooled, in which case, the motor is disposed in an oil sump 32 within the interior of the compressor housing. The oil serves also to lubricate the interacting elements of the compression mechanism and seal gaps to reduce leakage between the interacting elements during the compression process. However, the compressor drive motor 30 may be refrigerant vapor-cooled, which is the case when the compressor drive motor is disposed in a higher region of the interior of the compressor housing. In compressors with refrigerant vapor-cooled motors, a lubricant is generally added to the refrigerant circulating through the refrigerant circuit of the refrigerant vapor compression system to lubricate the interacting elements of the compression mechanism and seal gaps to reduce leakage between the interacting elements during the compression process.

Figure 3:
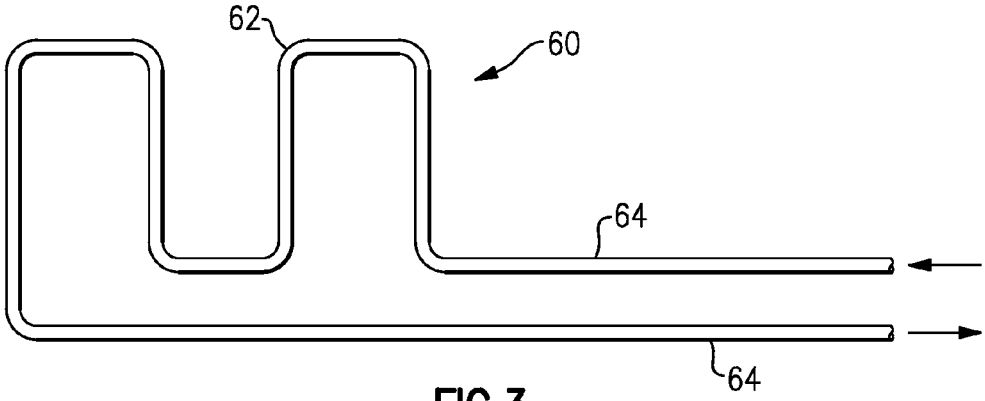
FIG. 3 is a side elevation view of the heat exchanger coil of the lubricant cooler circuit.

The refrigerant vapor compression system 10 of the invention includes an oil-cooler circuit 60 comprising a oil cooler heat exchange tube coil 62 disposed in heat exchange relationship with the cooled air having been passed over the heat exchanger 52 of the evaporator 50 by means of the evaporator fan(s) 54. As best seen in FIG. 3, the oil cooler heat exchange coil 62 has an inlet leg 64 and an outlet leg 66. The length of the oil cooler heat exchanger coil 62 disposed in the cooled air stream leaving the evaporator 50 must be determined on a case-by-case basis based on the desired oil return temperature, the oil mass flow, oil properties and the amount of heat rejected by the compressor drive motor.

Referring now to FIG. 1, in the embodiment depicted therein, the first leg 64 of the oil cooler heat exchange coil 62 is in fluid flow communication with the oil sump 32 of the compressor 20 to receive oil therefrom and an outlet leg 66 in fluid communication with the oil sump 32 for returning the cooled oil thereto. The oil is circulated from the oil sump 32 through the inlet leg 64, thence the oil cooler heat exchange coil 62 and thence returned via the outlet leg 66 to the oil sump 32 by means of an oil pump (not shown) disposed within the interior of the compressor housing and driven by the compressor drive motor 30.

Figure 2:
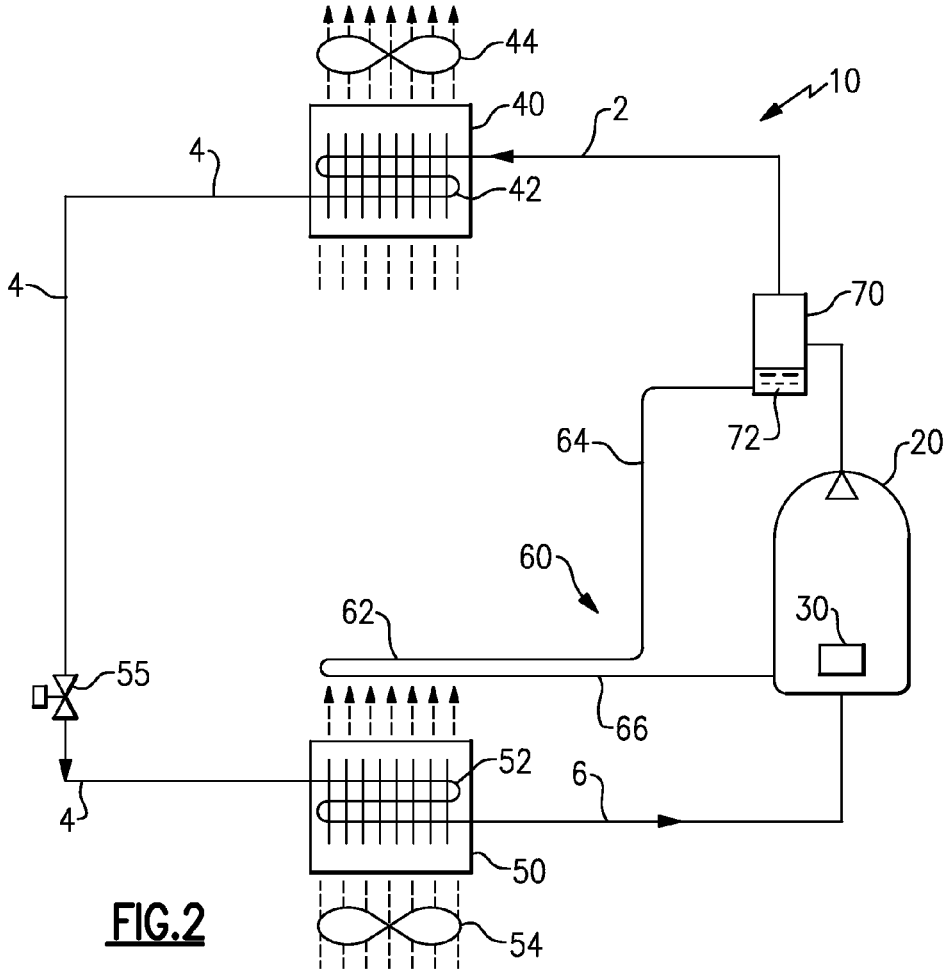
FIG. 2 is a schematic diagram illustrating an exemplary embodiment of a refrigerant vapor compression system in accord with the invention including an oil separator.

Referring now to FIG. 2, the refrigerant vapor compression system 10 depicted therein has a refrigerant vapor-cooled motor driving the compression device 20. In this embodiment, the oil-cooler circuit 60 of the refrigerant vapor compression system 10 further includes an oil separator 70 disposed in refrigerant line 2 downstream with respect to refrigerant flow of the compressor 20 and upstream with respect to refrigerant flow of the refrigerant heat rejection heat exchanger 40. In operation, the refrigerant vapor discharging from the compressor 20 passes, with lubricating oil entrained therein, into the oil separator 70 wherein the oil separates from the refrigerant vapor and collects in the lower reservoir 72 of the oil separator. In this embodiment, the inlet leg 64 of the oil-cooler heat exchange coil 62 is in fluid flow communication with the lower reservoir 72 of the oil separator 70 to receive oil therefrom and an outlet leg 66 in fluid communication with the compressor 20 for returning the cooled oil to the suction side of the compressor. The collected oil, being at compressor discharge pressure, flows by pressure differential through the inlet leg 64, thence the oil cooler heat exchange coil 60 and thence returns via the outlet leg 66 to the suction side of the compressor 20.

In either of the depicted embodiments, the oil flowing through the oil cooler heat exchanger coil 60 is cooled, typically by about 3° C. to about 20° C. (about 37.4° F. to about 68° F.), as it passes in heat exchange relationship with the cooled air passing from the evaporator 50 to return to the climate controlled environment. As this air passes in heat exchange relationship with the hot oil, the cooled air passing from the evaporator 50 is slightly reheated, typically by less than about 1-3° C. (1.8-5.4° F.).

Although described herein with respect to a basic non-economized refrigerant vapor compression system as depicted in FIGS. 1 and 2, it is to be understood that the oil-cooler circuit 60 may be readily employed in connection with various variations of the basic refrigerant vapor compression cycle. For example, the refrigerant vapor compression system could be equipped with an economizer circuit, a compressor unload circuit, a flash tank receiver or other enhancement.

The foregoing description is only exemplary of the teachings of the invention. Those of ordinary skill in the art will recognize that various modifications and variations may be made to the invention as specifically described herein and equivalents thereof without departing from the spirit and scope of the invention as defined by the following claims.

We claim:

1. A refrigerant vapor compression system comprising:

a refrigerant circuit including a refrigerant compression device, a refrigerant heat rejection heat exchanger for passing refrigerant received from said compression device at a high pressure in heat exchange relationship with a cooling medium, a refrigerant heat absorption heat exchanger for passing refrigerant at a low pressure refrigerant in heat exchange relationship with a heating medium; and;

a lubricant cooler circuit operatively associated with said compression device for cooling a lubricant associated with said compression device, said lubricant cooler circuit including a heat exchanger coil disposed downstream of said refrigerant heat absorption heat exchanger with respect to the flow of heating medium and defining a flow path for passing the lubricant in heat exchanger relationship with the cooled heating medium leaving said refrigerant heat absorption heat exchanger.

2. The vapor compression system as recited in claim 1 wherein said refrigerant heat absorption heat exchanger comprises a refrigerant evaporator heat exchanger and said heating medium comprises air from a climate controller environment.

3. The vapor compression system as recited in claim 2 wherein said climate controller environment comprises a perishable cargo storage zone of a refrigerated transport container.

4. The vapor compression system as recited in claim 1 wherein the lubricant cooler heat exchanger coil further includes an inlet leg for passing lubricant to be cooled to the lubricant flow path through the lubricant cooler heat exchanger coil and an outlet leg for passing lubricant having been cooled from the lubricant flow path through the lubricant cooler heat exchanger coil.

5. The vapor compression system as recited in claim 4 wherein said compression device comprises a hermetic compressor having a casing housing a compression mechanism, an oil-cooled motor driving the compression mechanism, and an oil sump for collecting oil for cooling the motor; and the inlet leg of the lubricant cooler heat exchanger coil being in flow communication with the oil sump of said hermetic compressor for receiving oil to be cooled and the outlet leg of the lubricant cooler heat exchanger coil being in flow communication with the oil sump of said hermetic compressor for returning oil having been cooled to the oil sump.

6. The vapor compression system as recited in claim 4 wherein said compression device comprises a hermetic compressor having a casing housing a compression mechanism and a motor driving the compression mechanism; and said lubricant cooler circuit further includes an oil separator disposed in said primary refrigerant circuit upstream with respect to refrigerant flow of said compressor and downstream with respect to refrigerant flow of said refrigerant heat rejection heat exchanger, the inlet le fog the lubricant cooler heat exchanger being in flow communication with the oil separator for receiving oil to be cooled and the outlet leg of the lubricant cooler heat exchanger coil being in flow communication with said hermetic compressor for returning oil having been cooled to said hermetic compressor.

* * * * *